US007292219B2

(12) United States Patent
Sun

(10) Patent No.: US 7,292,219 B2
(45) Date of Patent: Nov. 6, 2007

(54) DATA DRIVER FOR ORGANIC LIGHT EMITTING DIODE DISPLAY

(75) Inventor: Wein-Town Sun, Kaohsiung (TW)

(73) Assignee: Au Optronics Corp., Hsinchu (TW)

( * ) Notice: Subject to any disclaimer, the term of this patent is extended or adjusted under 35 U.S.C. 154(b) by 547 days.

(21) Appl. No.: 11/026,110

(22) Filed: Dec. 30, 2004

(65) Prior Publication Data

US 2005/0225517 A1 Oct. 13, 2005

(30) Foreign Application Priority Data

Apr. 8, 2004 (TW) ..... 93109793 A

(51) Int. Cl.
*G09G 3/36* (2006.01)

(52) U.S. Cl. ..... 345/100; 345/82; 345/98

(58) Field of Classification Search ..... 345/55–100, 345/204–214; 315/169.3
See application file for complete search history.

(56) References Cited

U.S. PATENT DOCUMENTS 6,256,024 B1 7/2001 Maekawa ..... 345/205
6,664,943 B1 * 12/2003 Nakajima et al. ..... 345/98
6,686,858 B2 * 2/2004 Nagao ..... 345/55
6,909,411 B1 * 6/2005 Yamazaki et al. ..... 345/98

* cited by examiner

*Primary Examiner*—David L. Lewis
(74) *Attorney, Agent, or Firm*—Thomas, Kayden, Horstemeyer & Risley

(57) ABSTRACT

A data driver for organic light emitting diode display is disclosed. A pixel data of K bits is divided into an N bits data and an M bits data. A number of N bits data are processed by a number of main digital-to-analog current converters and a number of main voltage storing current copier/current mirror so as to generate a number of main regenerating currents. Besides, a number of M bits data are processed by a number of secondary digital-to-analog current converters and a number of secondary voltage storing current copier/current mirror so as to generate a number of secondary regenerating currents. The brightness of the pixel is related to the sum of the corresponding main regenerating current and the corresponding secondary regenerating current. The invention can reduce the error resulted from the component variation of digital-to-analog converters.

13 Claims, 14 Drawing Sheets

DATA DRIVER FOR ORGANIC LIGHT EMITTING DIODE DISPLAY

This application claims the benefit of Taiwan Application Patent Serial No. 93109793, filed Apr. 8, 2004, the subject matter of which is incorporated herein by reference.

BACKGROUND OF THE INVENTION

1. Field of the Invention

The invention relates in general to a data driver, and more particularly to a data driver for organic light emitting diode display.

2. Description of the Related Art

Referring to FIG. 1, a driving circuit 100 for a conventional thin film transistor (TFT) liquid crystal display (LCD) panel is shown. The driving circuit 100 includes a horizontal shift register 102, a level shifter 104, a latch 106, a digital-to-analog converter (DAC) 108, and a vertical shift register 110.

The horizontal shift register 102 outputs X horizontal shift control signals HSR(1)~HSR(X) to respectively control switch set 114(1)~switch set 114(X), wherein X is a positive integer. The X horizontal shit control signals HSR(1 )~HSR (X) are sequentially enabled so that the X switch sets 114(1)~114(X) can be sequentially turned on. Meanwhile, X K-bit pixel data Dt will be sequentially transmitted to corresponding level shifters 104 by the turned-on switch sets 114. Take the first pixel data Dt(1) for example. After receiving the pixel data Dt(1), the level shifter 104(1) will amplify the pixel data Dt(1) and output the amplified pixel data Dt(1) to the latch 106(1). The latch 106(1) will transmit the Dt(1) to the digital-to-analog converter 108(1) for digital-to-analog conversion to generate an analog voltage V(1) accordingly.

The vertical shift register 110 outputs a plurality of vertical shift control signals, VSR(1 )~VSR(3) for instance. The vertical shit control signals VSR(1 )~VSR(3) are sequentially enabled so that the analog voltages V(1)~V(X) outputted by the digital-to-analog converters 108(1)~108(X) can be sequentially transmitted to their corresponding pixels 112. The brightness of the pixel 112 is related to the analog voltage V received.

By replacing the digital-to-analog converter 108 of the conventional TFT LCD driving circuit illustrated in FIG. 1 with a digital-to-analog current converter which converts digital data into analog currents and replacing the pixel with the current driven type OLED (organic light emitting diode) pixel, a driving circuit for a current driven type TFT-OLED panel can be obtained.

However, the TFT threshold voltage and mobility in different digital-to-analog circuits may not be the same, so that error may occur in the current outputted by the digital-to-analog circuit, resulting in non-uniform brightness across the pixels of the TFT-OLED panel. Therefore, how to reduce the error resulted from the component variation of digital-to-analog circuits has thus become an important issue to be resolved.

SUMMARY OF THE INVENTION

It is therefore an object of the invention to provide a data driver for organic light emitting diode display, which effectively reduces the error in the output current of a digital-to-analog circuit so as to provide a more uniform brightness across the pixels of the TFT-OLED panel.

The invention achieves the above-identified object by providing a data driver to be applied in a display which has a first pixel and a second pixel. The data driver receives a first pixel data and a second pixel data, both of which have K bits where K is a positive integer. The data driver according to the invention includes a first main digital-to-analog current converter and a second main digital-to-analog current converter, a first main voltage storing current copier/current mirror and a second main voltage storing current copier/current mirror, an secondary digital-to-analog current converter, a first secondary voltage storing current copier/current mirror and a second secondary voltage storing current copier/current mirror.

The first main digital-to-analog current converter and the second main digital-to-analog current converter convert N bits of the first pixel data and N bits of the second pixel data into a first main output current and a second main output current respectively, wherein N is a positive integer. The first main voltage storing current copier/current mirror and the second main voltage storing current copier/current mirror output a first main regenerating current and a second main regenerating current respectively according to the first main output current and the second main output current. The secondary digital-to-analog current converter sequentially receives M bits from the first pixel data and M bits from the second pixel data to correspondingly generate a first secondary output current and a second secondary output current, wherein M is a positive integer and the sum of N and M is larger than K. The first secondary voltage storing current copier/current mirror and the second secondary voltage storing current copier/current mirror output a first secondary regenerating current and a second secondary regenerating current respectively according to the first secondary output current and the second secondary output current.

After the first pixel receiving the first main regenerating current and the first secondary regenerating current, the brightness of the first pixel corresponds to the sum of the first main regenerating current and the first secondary regenerating current. After the second pixel receiving the second main regenerating current and the second secondary regenerating current, the brightness of the second pixel corresponds to the sum of the second main regenerating current and the second secondary regenerating current.

Other objects, features, and advantages of the invention will become apparent from the following detailed description of the preferred but non-limiting embodiments. The following description is made with reference to the accompanying drawings.

BRIEF DESCRIPTION OF THE DRAWINGS

FIGS. 4A and 4B are an example of the circuit structure of a main voltage storing current copier/current mirror 212(1), wherein FIG. 4A shows the main current mirror 212(1) with Vgs stored function in the current storing mode, while FIG. 4B shows the main current mirror 212(1) with Vgs stored function in the current regenerating mode;

DETAILED DESCRIPTION OF THE INVENTION

Embodiment One

Figure 1:
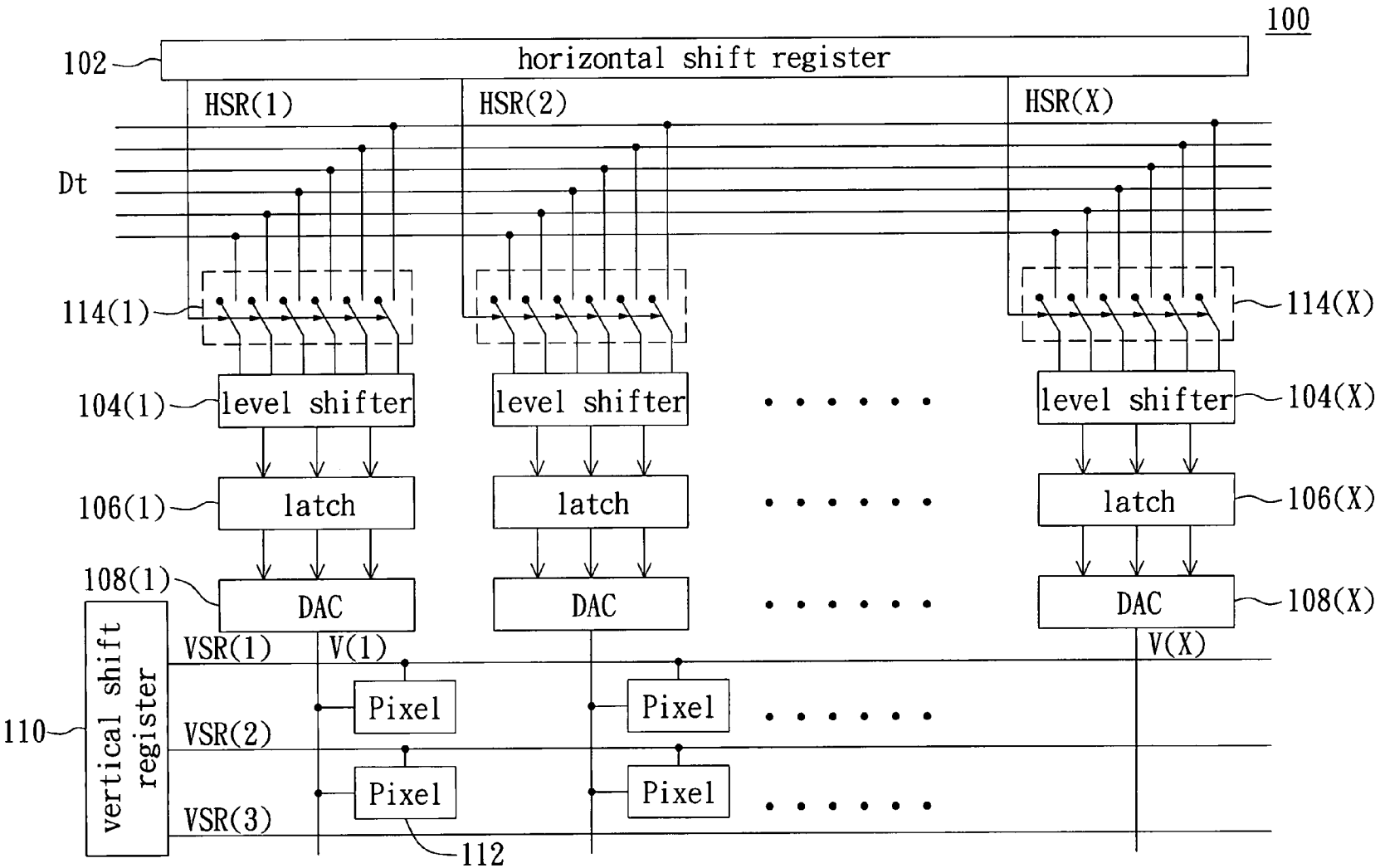
FIG. 1(PRIOR ART)
FIG. 1 shows a data driver 100 for a conventional TFT LCD panel.
Figure 2:
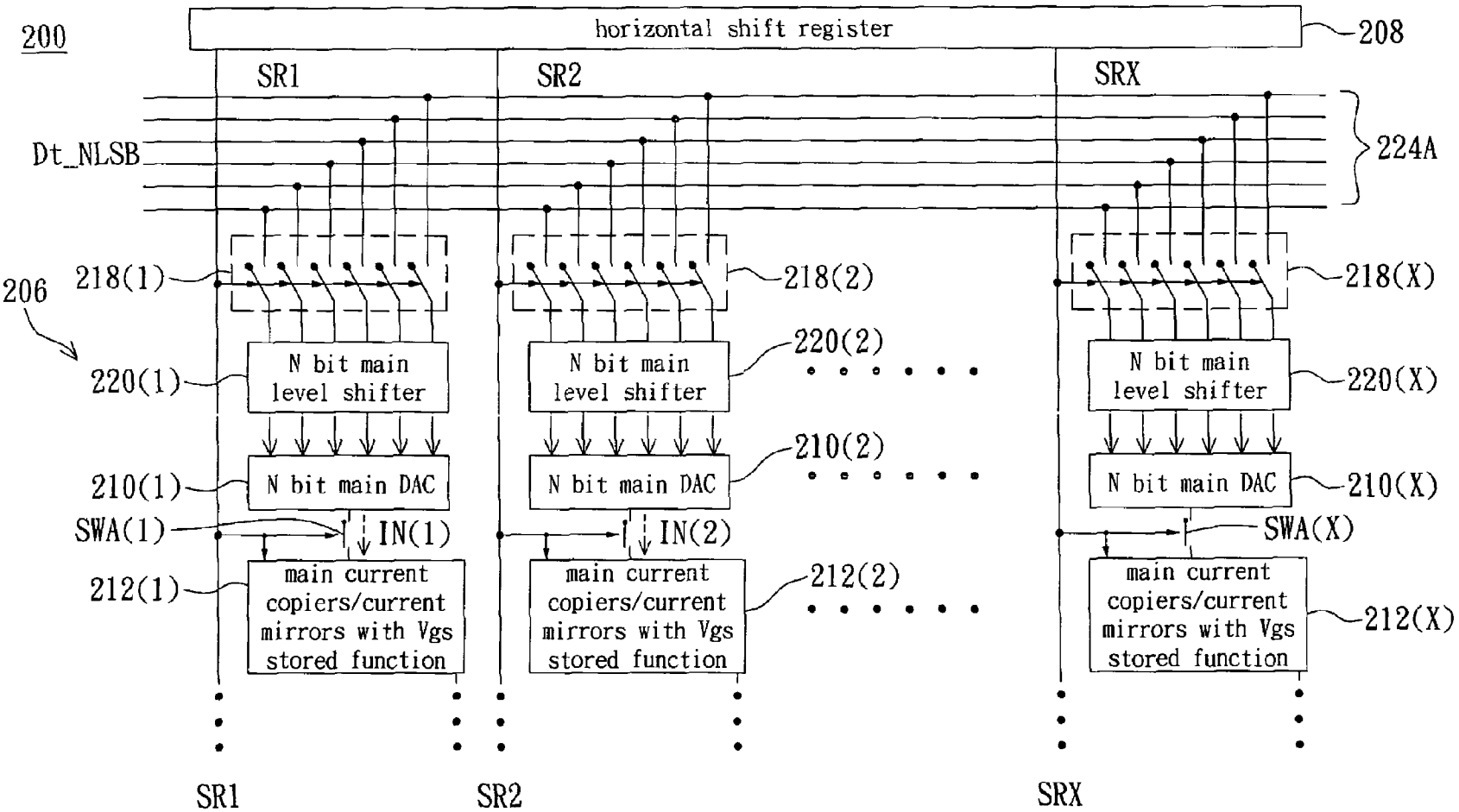
FIG. 2 is a driving circuit for an OLED display according to the first embodiment of the invention.
Figure 2:
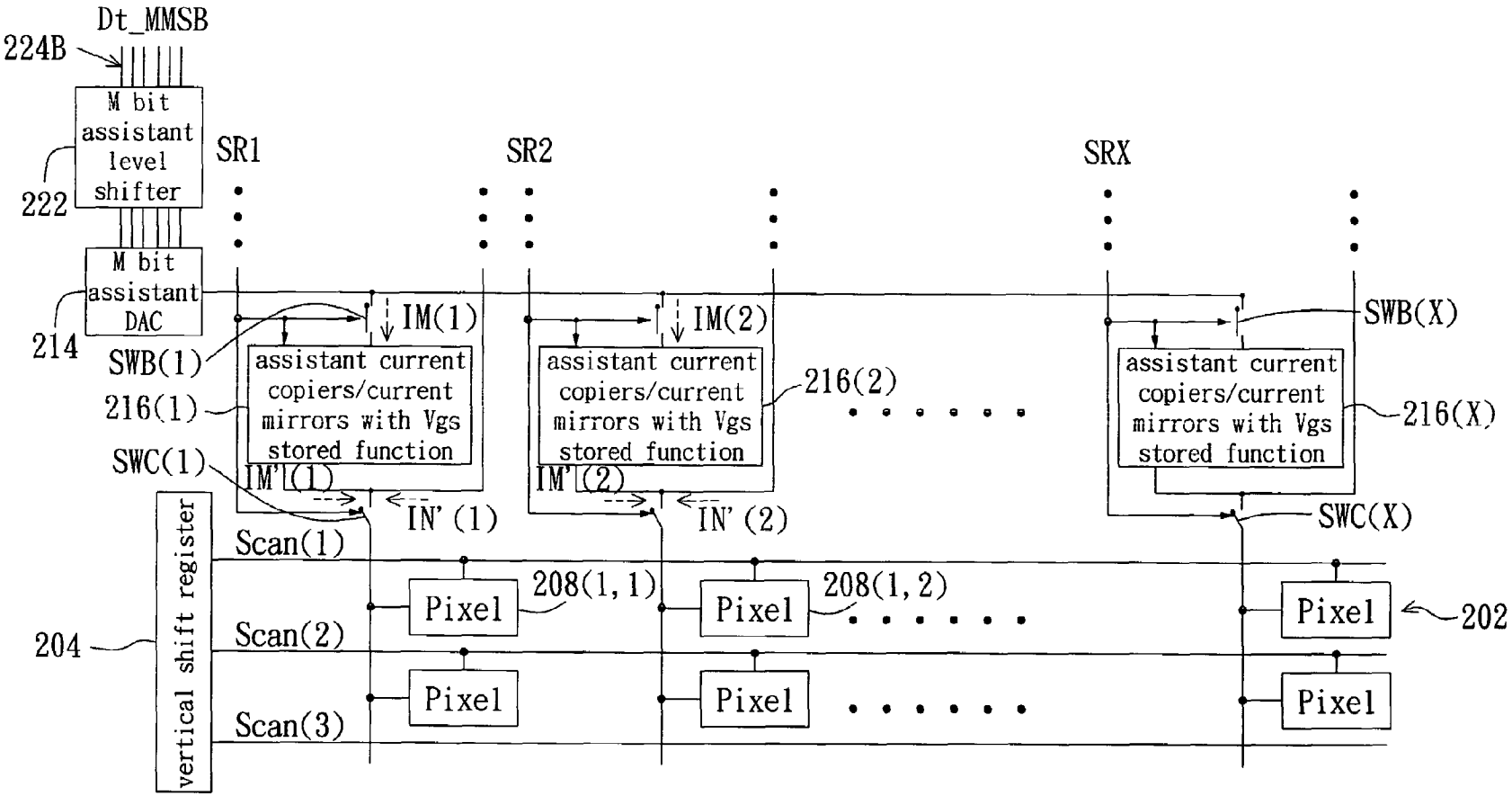

Referring to FIG. 2, a driving circuit for OLED display according to the first embodiment of the invention is shown. In FIG. 2, an OLED display 200, which includes a pixel array 202, a vertical shift register 204, and a data driver 206, is illustrated. The pixel array 202 includes multi-row and multi-column OLED pixels such as pixel 208(1, 1) and pixel 208(1, 2) in the first pixel row. The vertical shift register 204 outputs a number of scan signals Scan to the pixel array 202, wherein each scan signal respectively controls the pixels in one row. For example, the scan signal Scan(1) is outputted to the first row of the pixel array 202 to control the pixels in the first row. The data driver 206 receives a number of pixel data such as pixel data Dt(1, 1) and Dt(1, 2) which respectively correspond to the pixels 208(1, 1) and 208(1, 2). Both pixel data Dt(1, 1) and Dt(1, 2) have K bits where K is a positive integer.

Take the pixel array 202 having X-column pixels where X is a positive integer for example. The data driver 206 includes a horizontal shift register 208, X main digital-to-analog current converters 210, X main current copiers/current mirrors with Vgs stored function 212, an secondary digital-to-analog current converter 214 and X secondary current copiers/current mirrors with Vgs stored function 216. The horizontal shift register 208 outputs (X+1) horizontal control signals SR0~SRX(SR0 is not shown in FIG. 2). The X main digital-to-analog current converters 210(1)~210(X) are respectively controlled by the control signals SR1~SRX to receive N bits from every pixel data Dt corresponding to a particular pixel row to respectively generate corresponding main output currents IN(1)~IN(X), wherein N is a positive integer. The X main voltage storing current copier/current mirror respectively output regenerating currents IN'(1 )~IN'(X) according to the main output currents IN(1 )~IN(X).

The secondary digital-to-analog current converter 214 sequentially receives an M bits data from every pixel data Dt corresponding to a particular pixel row and generates corresponding secondary output currents IM(1)~IM(X), wherein M is a positive integer and the sum of M and N is larger than K or equal to K, preferably the sum of M and N is equal to K. The X secondary current copiers/current mirrors with Vgs stored function 216(1)~216(X) respectively output regenerating currents IM'(1)~IM'(X) according to the secondary output currents IM(1)~IM(X).

The main regenerating currents IN'(1)~IN'(X) and the secondary regenerating currents IM'(1)~IM'(X) are respectively inputted to all of the pixels in a particular row. After having received the main regenerating currents IN'(1)~IN'(X) and the secondary regenerating currents IM'(1)~IM'(X), the brightness of each pixel in a particular row corresponds to the sum of corresponding main regenerating current IN' and secondary regenerating current IM'.

The characteristics of the technology according to the invention are further described below. The data driver 206 can further include X switch sets 218(1)~218(X), X main level shifters 220(1)~220(X) and a secondary level shifter 222. The main level shifters 220(1)~220(X) are N-bit level shifters, while the secondary level shifters 222 is an M-bit level shifter. A signal transmission line 224A is selectively electrically connected to the level shifters 220(1)~220(X) via the X switch sets 218(1)~218(X), while the main level shifters 220(1)~220(X) are respectively electrically connected to the main digital-to-analog current converters 210(1)~210(X).

The main digital-to-analog current converters 210(1)~210(X) are controlled by the horizontal control signals SR1~SRX to receive an N bits data from X pixel data Dt. That is to say, when the horizontal control signals SR0~SRX are sequentially enabled, the switch sets 218(1)~218(X) will be sequentially turned on under the control of the horizontal control signals SR1~SRX. Meanwhile, the N bits data of the X pixel data Dt will be sequentially transmitted to their corresponding main level shifters 220(1)~220(X) via the turned-on switch sets 218(1)~218(X). The main level shifters 220(1)~220(X) amplify the N bits data of the X pixel data Dt and output the N bits data of the X pixel data Dt to the main digital-to-analog current converters 210(1)~210(X).

The main digital-to-analog current converters 210(1)~210(X) are respectively electrically connected to the main current copiers/current mirrors with Vgs stored function 212(1)~212(X) via switches SWA(1)~SWA(X), wherein the switches SWA(1)~SWA(X) are controlled by the horizontal control signals SR1~SRX. The main current copiers/current mirrors with Vgs stored function 212(1)~212(X), which are also controlled by the horizontal control signals SR1~SRX, can be in the current storing mode or in the current regenerating mode.

When the horizontal control signals SR1~SRX are sequentially enabled, for example, change to high level, the switches SWA(1)~SWA(X) will be sequentially turned on while the main current copiers/current mirrors with Vgs stored function 212(1)~212(X) change to the current storing mode to sequentially receive the main output currents IN(1)~IN(X). To the contrary, when the horizontal control signals SR1~SRX are sequentially disabled, for example change to low level, the switches SWA(1)~SWA(X) will be sequentially turned off while the main current copiers/current mirrors with Vgs stored function 212(1)~212(X) change to the current regenerating mode to sequentially output the main regenerating currents IN'(1)~IN'(X). The magnitude of the main regenerating currents IN'(1)~IN'(X) are substantially equal to that of the main output currents IN(1)~IN(X).

On the other hand, a signal transmission line 224B is electrically connected to the secondary level shifter 222, wherein the secondary level shifter 222 is electrically connected to the secondary digital-to-analog current converter 214. The secondary level shifter 222 sequentially receives and amplifies the M bits data of the X pixel data Dt, wherein the amplified M bits data of the X pixel data Dt are sequentially inputted into the secondary digital-to-analog current converter 214 for digital-to-analog conversion to output the secondary output currents IM(1)~IM(X) to the secondary current copiers/current mirrors with Vgs stored function 216(1)~216(X).

The secondary current copiers/current mirrors with Vgs stored function 216(1)~216(X), which are also controlled by the horizontal control signals SR1~SRX, have a current storing mode and a current regenerating mode. When the horizontal control signals SR1~SRX are respectively enabled, the secondary current copiers/current mirrors with Vgs stored function 216(1)~216(X) respectively change to the current storing mode and respectively receive the secondary output current IM(1)~IM(X). Likewise, when the horizontal control signals SR1~SRX are respectively disabled, the secondary current copiers/current mirrors with Vgs stored function 216(1)~216(X) respectively change to the current regenerating mode and continue to output the secondary regenerating currents IM'(1)~IM'(X). The magnitude of the secondary regenerating currents IM'(1)~IM'(X) are substantially equal to that of the secondary output currents IM(1)~IM(X).

The data driver 206 further includes X switches SWC(1)~SWC(X). Both the output end of the main voltage storing current copier/current mirror 212(1) and that of the secondary voltage storing current copier/current mirror 216(1) are electrically connected to a first end of the switch SWC(1), while a second end of the switch SWC(1) is electrically connected to the pixel 208(1, 1). Likewise, both the output end of the main voltage storing current copier/current mirror 212(2) and that of the secondary voltage storing current copier/current mirror 216(2) are electrically connected to a first end of the switch SWC(2), while a second end of the switch SWC(2) is electrically connected to the pixel 208(1, 2).

When the horizontal control signal SR1 is disabled, the switch SWC(1) is turned on, the main regenerating current IN'(1) and the secondary regenerating current IM'(1) are inputted into the pixel 208(1, 1) at the same time, so that the brightness produced by the pixel 208(1, 1) corresponds to the sum of the main regenerating current IN'(1) and the secondary regenerating current IM'(1). Likewise, when the horizontal control signal SR2 is disabled, the switch SWC(2) is turned on so that the main regenerating current IN'(2) and the secondary regenerating current IM'(2) are inputted into the pixel 208(1, 2) at the same time, so that the brightness produced by the pixel 208(1, 2) corresponds to the sum of the main regenerating current IN'(2) and the secondary regenerating current IM'(2). The connection between the switches SWC(3)~SWC(X) and the output ends of the remaining main current copiers/current mirrors with Vgs stored function 212(3)~212(X) and secondary current copiers/current mirrors with Vgs stored function 216(3)~216(X) and the operation thereof can be obtained in the same way and are not repeated here.

The N bits data of the pixel data Dt are preferably to be N-bit least significant bit (LSB) data Dt_NLSB, while the M bits data of the pixel data Dt are preferably to be M-bit most significant bit (MSB) data Dt_MMSB. The corresponding analog current of the pixel data Dt is equivalent to the sum of the corresponding analog current of the N-bit LSB data Dt_NLSB and that of the M-bit MSB data Dt_MMSB.

Take the pixel data $(101100)_2$ for example, its N-bit LSB data and M-bit MSB data are respectively $(100)_2$ and $(101)_2$. Given that $(101100)_2=(101)_2*2^3+(100)_2$, the corresponding analog current of $(101100)_2$ can be obtained as follows. First, generate the corresponding analog current of $(101)_2$ and that of $(100)_2$, then multiply the corresponding analog current of $(101)_2$ by $2^3$. Next, add the corresponding analog current of $(101)_2*2^3$ to the corresponding analog current of $(100)_2$. The sum obtained is exactly the corresponding analog current of $(101100)_2$. The step of multiplying the M-bit MSB data by $2^3$ can be achieved by using a current source which is $2^3$ times of the current value of the secondary digital-to-analog current converter 214.

Since Dt_MMSB, the M-bit MSB data of the pixel data Dt, has much greater influence on pixel brightness than Dt_NLSB, the N-bit LSB data of the pixel data Dt, would have, all the pixels in the invention share the same secondary digital-to-analog current converter 214 to convert the Dt_MMSB of all pixel data Dt into analog data to provide more uniform brightness of the display. In the conventional method, the pixel data in different pixel columns use different digital-to-analog current converters. However, errors will occur in output current because the TFT threshold voltage and mobility in different digital-to-analog current converters may be different. Compared with the conventional method, the method according to the first embodiment effectively reduces errors in output current caused by different TFT threshold voltage and mobility of different digital-to-analog current converters for all the pixels in the invention share the same secondary digital-to-analog current converter 214 to convert the Dt_MMSB of all pixel data Dt into analog data.

An example of the main digital-to-analog current converter 210(1), the main voltage storing current copier/current mirror 212(1), the secondary voltage storing current copier/current mirror 216(1), the pixel 208(1, 1) and the secondary digital-to-analog current converter 214(1) is disclosed below. Let the pixel data Dt have 6 bits arranged from right to left in the order of D0, D1, D2, D3, D4 and D5, i.e., the pixel data Dt equals $(D5\ D4\ D3\ D2\ D1\ D0)_2$, and further let M=N=3. The M-bit MSB data is $(D5\ D4\ D3)_2$, while the N-bit LSB data is $(D2\ D1\ D0)_2$.

Figure 3:
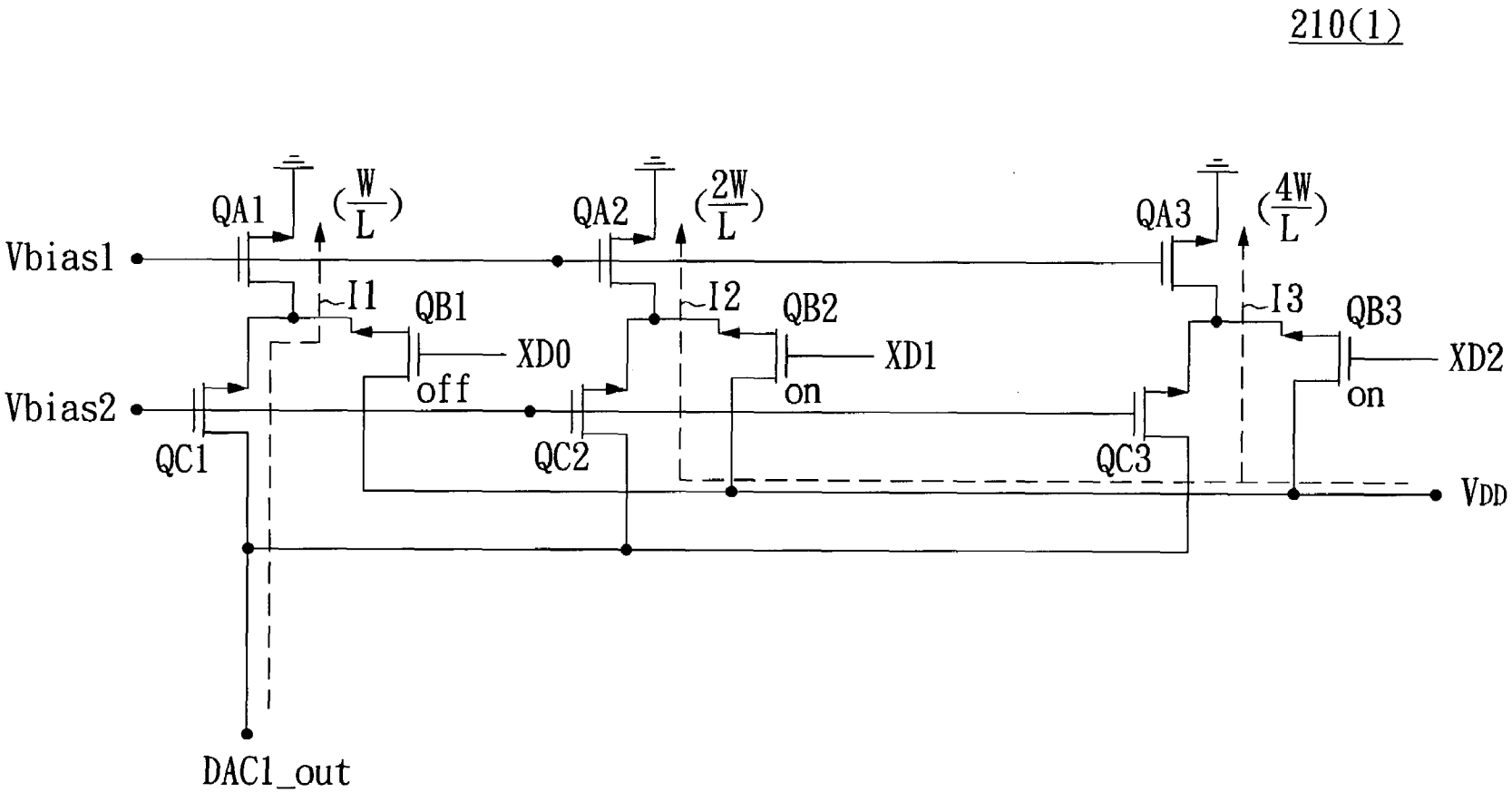
FIG. 3 is an example of the circuit structure of a main digital-to-analog current converter 210(1)

Referring to FIG. 3, an example of the circuit structure of a main digital-to-analog current converter 210(1) is shown. The main digital-to-analog current converter 210(1) includes 9 N-type transistors, namely, QA1~QA3, QB1~QB3 and QC1~QC3. The sources of the transistors QA1~QA3 are grounded, while the gates of the transistors QA1~QA3 are biased to a voltage Vbias1. The sources of the transistors QB1~QB3 are respectively coupled to the drains of the transistors QA1~QA3, while the gates of the transistors QB1~QB3 respectively receive XD0, XD1 and XD2, the anti-phase signals of signals D0, D1 and D2. The sources of the transistors QC1~QC3 are respectively coupled to the drains of the transistors QA1~QA3, while the gates of the transistors QC1~QC3 are biased to a voltage Vbias2. The transistors QA1~QA3, with the respective width-to-length ratio of transistor channel being W/L, 2W/L and 4W/L, generate currents I1, 2I1 and 4I1. When the N-bit LSB data $(D2\ D1\ D0)_2$ equals $(001)_2$ $(XD2\ XD1\ XD0)_2$ equals $(110)_2$ Consequently, the transistor QB1 is turned off, while both transistors QB2 and QB3 are turned on. Meanwhile, DAC1_out, the output end of the main digital-to-analog current converter 210, will drain the current of the main output current IN(1) whose current equals I1.

Figure 4A:
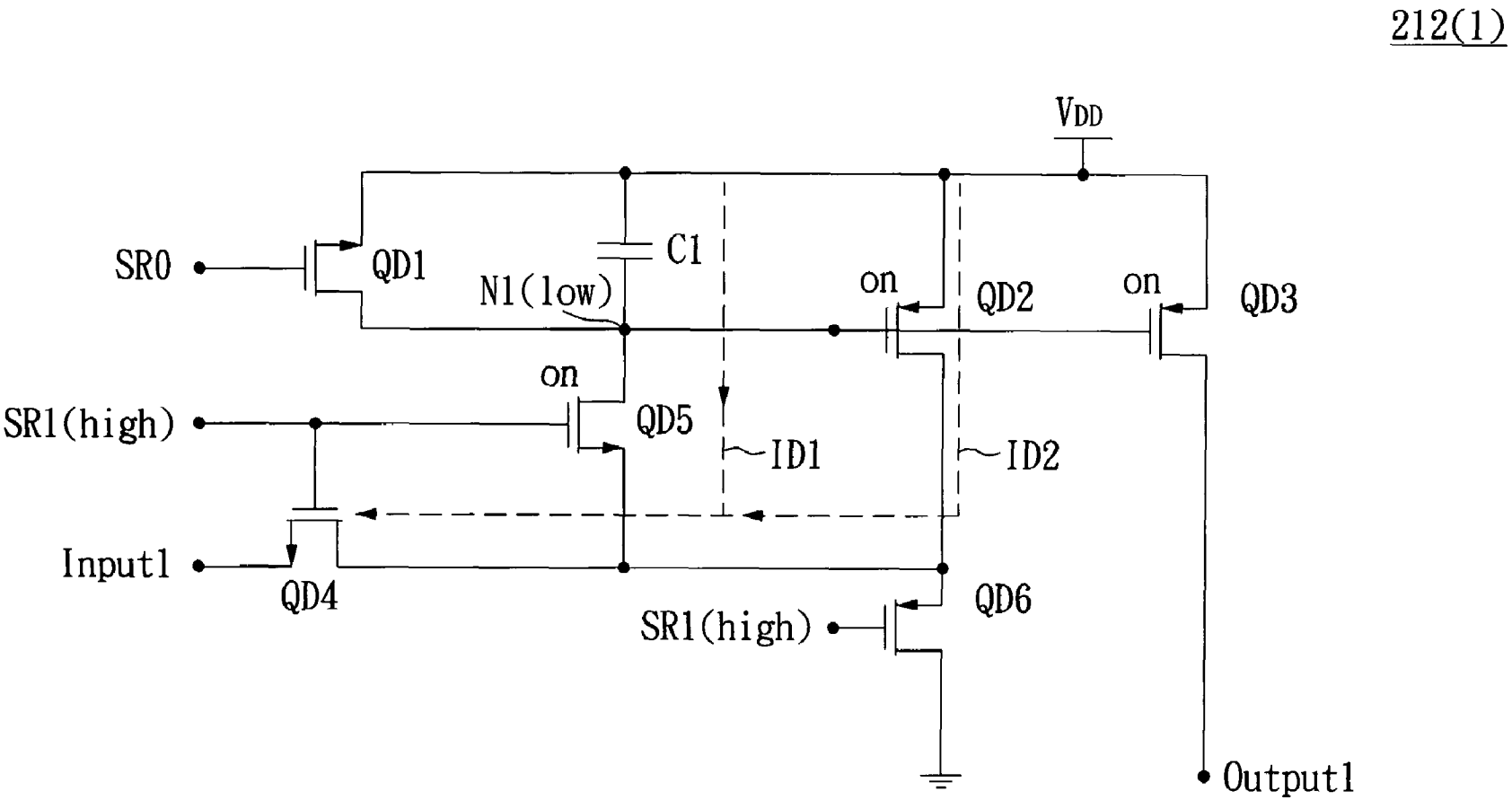
Figure 4B:
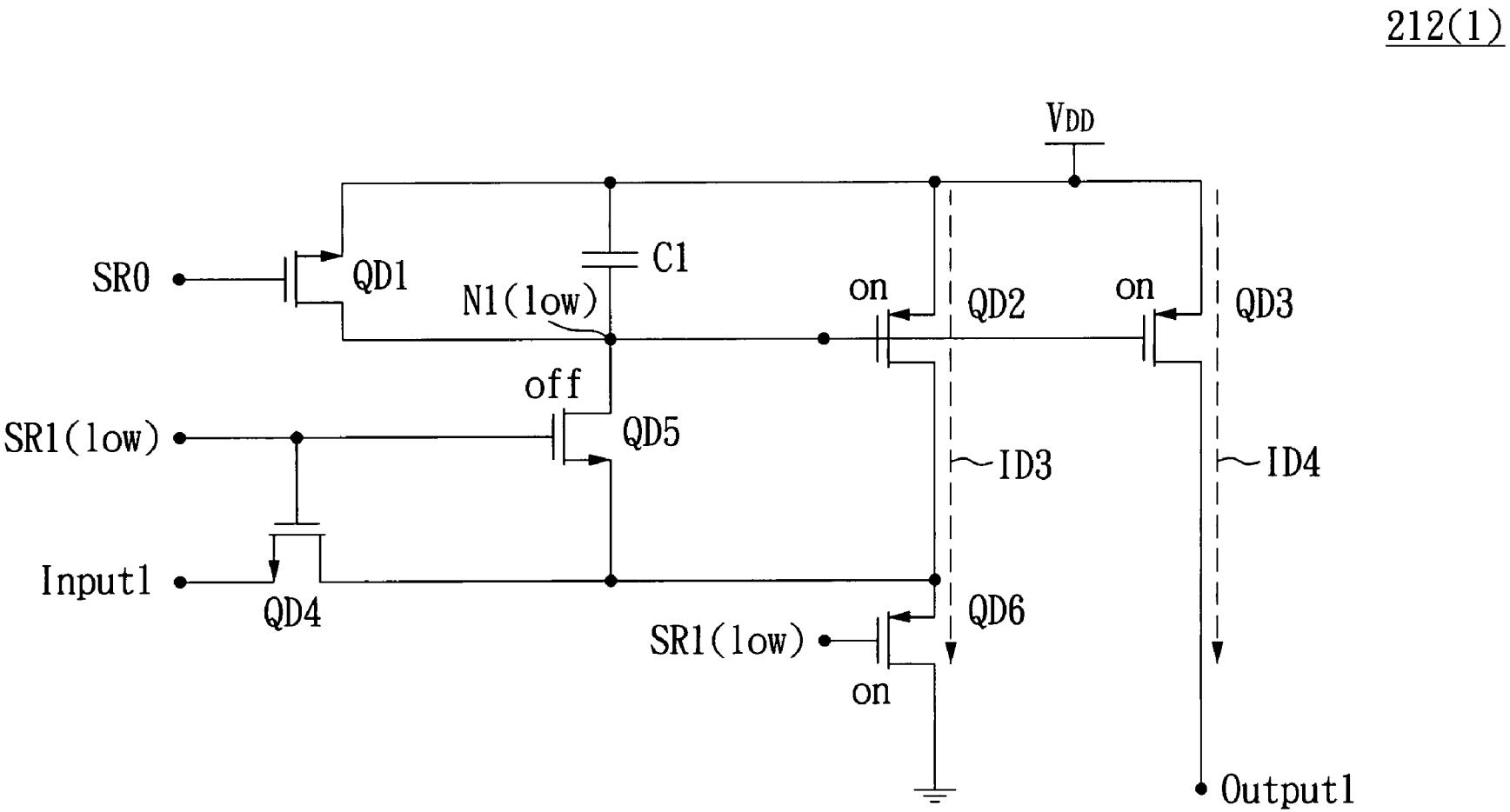

Referring to FIG. 4A and FIG. 4B, an example of the circuit structure of the main current copiers/current mirrors with Vgs stored function 212(1) is shown. FIG. 4A shows the main current mirror 212(1) with Vgs stored function in the current storing mode , while FIG. 4B shows the main current mirror 212(1) with Vgs stored function in the current regenerating mode.

The main voltage storing current copier/current mirror 212 includes N-type transistors QD1, QD4 and QD5, and P-type transistors QD2, QD3 and QD6. The input end Input1 is coupled to the output end DAC_out of the main digital-to-analog current converter 210(1) via the switch SWA(1).

The sources of the transistors QD1, QD2 and QD3 are coupled to a high-level VDD, while the drain of the transistor QD1 as well as the gates of the transistors QD2 and QD3 are coupled to a node N1. The two ends of capacitor C1 are respectively coupled to the gate and the source of the transistor QD2. The drain of the transistor QD2, the source of the transistor QD5 and the drain of the transistor QD4 are coupled to the source of the transistor QD6. The drain of the transistor QD6 is grounded. The drain of the transistor QD3 is used as an output end Output1. The gate of the transistor QD1 receives the horizontal control signal SR0, while the gates of the transistors QD4, QD5 and QD6 receive the horizontal control signal SR1.

When the horizontal control signal SR0 is enabled, the transistor QD1 is turned on, the capacitor C1 is discharged so as to reduce the cross-voltage of the capacitor C1 to 0 for the capacitor C1 to be reset. When the horizontal control signal SR1 is enabled, the main voltage storing current copier/current mirror 212(1) changes to the current storing mode, the transistors QD4 and QD5 are turned on to generate a current ID1. Meanwhile, the transistor QD6 is turned off. When the capacitor C1 is charged to a first specific level, the transistor QD2 will be turned on to generate a current ID2. When the capacitor C1 continues to be charged to a second specific level, the current ID2 will be equal to the current I1 illustrated in FIG. 3. The capacitor C1 will stop charging and will be maintained at the second specific level.

Referring to FIG. 4B, when the horizontal control signal SR1 is disabled, the main voltage storing current copier/current mirror 212(1) changes to the current regenerating mode, while the transistor QD6 is turned on, but the transistors QD4 and QD5 are not. Meanwhile, as the capacitor C1 is maintained at the second specific level, the transistor QD2 continues to be turned on and generates a current ID3, wherein ID3 is substantially equal to I1. As the voltage difference between the source and the gate of the transistor QD3 is the same with that of the transistor QD2, the transistor QD3 will have a current ID4 flowing through, wherein the current ID4 is substantially equal to the current ID3 which is substantially equal to the current I1. At this time, the main voltage storing current copier/current mirror 212(1) will output the main regenerating current IN'(1) which equals 14.

Figure 5:
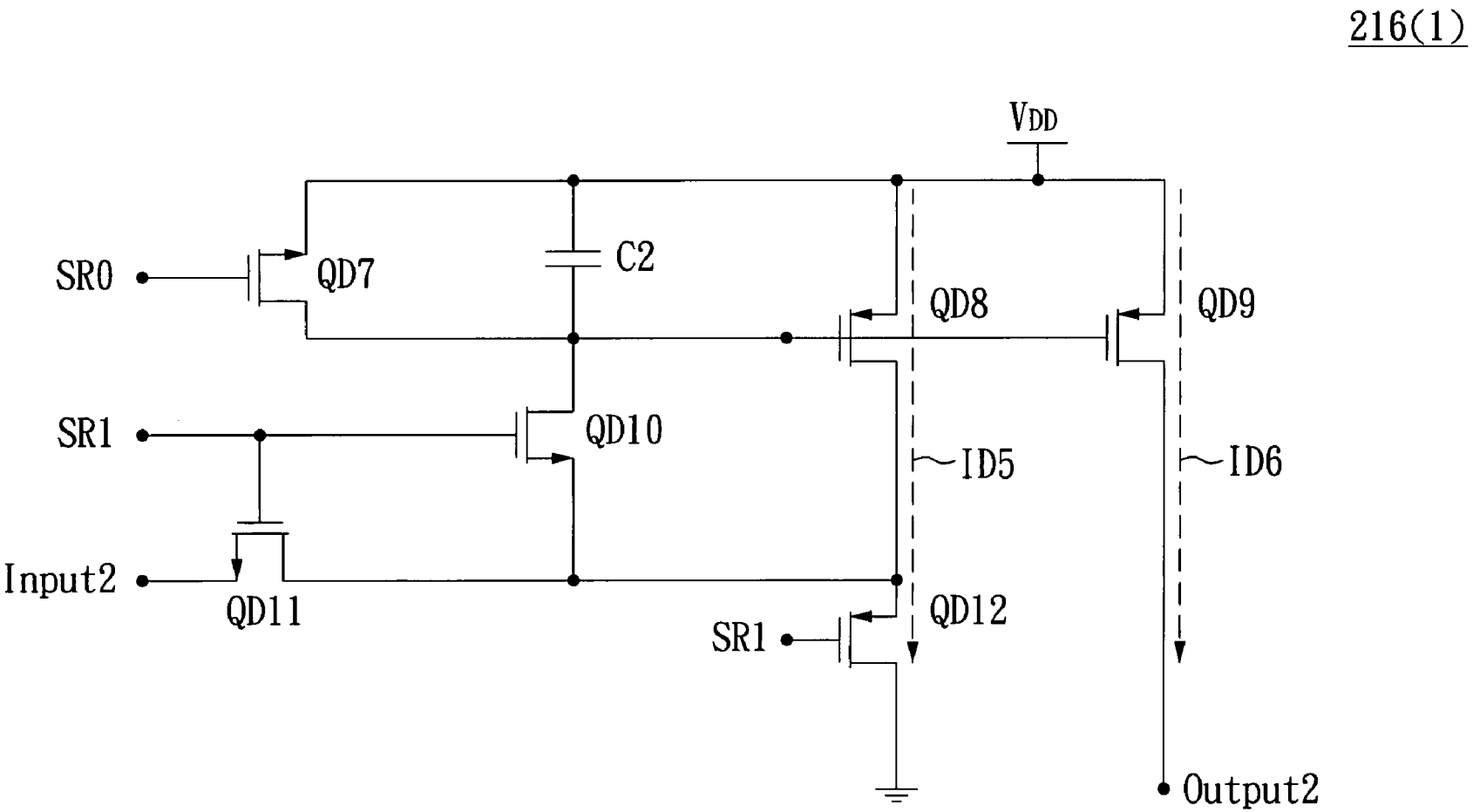
FIG. 5 is an example of the circuit structure of an secondary voltage storing current mirror 216(1)

Referring to FIG. 5, an example of the circuit structure of a secondary voltage storing current copier/current mirror 216(1) is shown. The secondary voltage storing current copier/current mirror 216(1) includes N-type transistors QD7, QD10 and QD11, and P-type transistors QD8, QD9 and QD12. The connection and operation of the secondary voltage storing current copier/current mirror 216(1) are similar to that of the main voltage storing current copier/current mirror 212(1). In the current regenerating mode, the cross-voltage of the capacitor C2 is maintained at a third specific level, currents ID5 and ID6 respectively flow through the transistors QD8 and QD9. Meanwhile, the secondary voltage storing current copier/current mirror 216(1) will output the current whose secondary regenerating current IM'(1) which equals ID6.

Figure 6A:
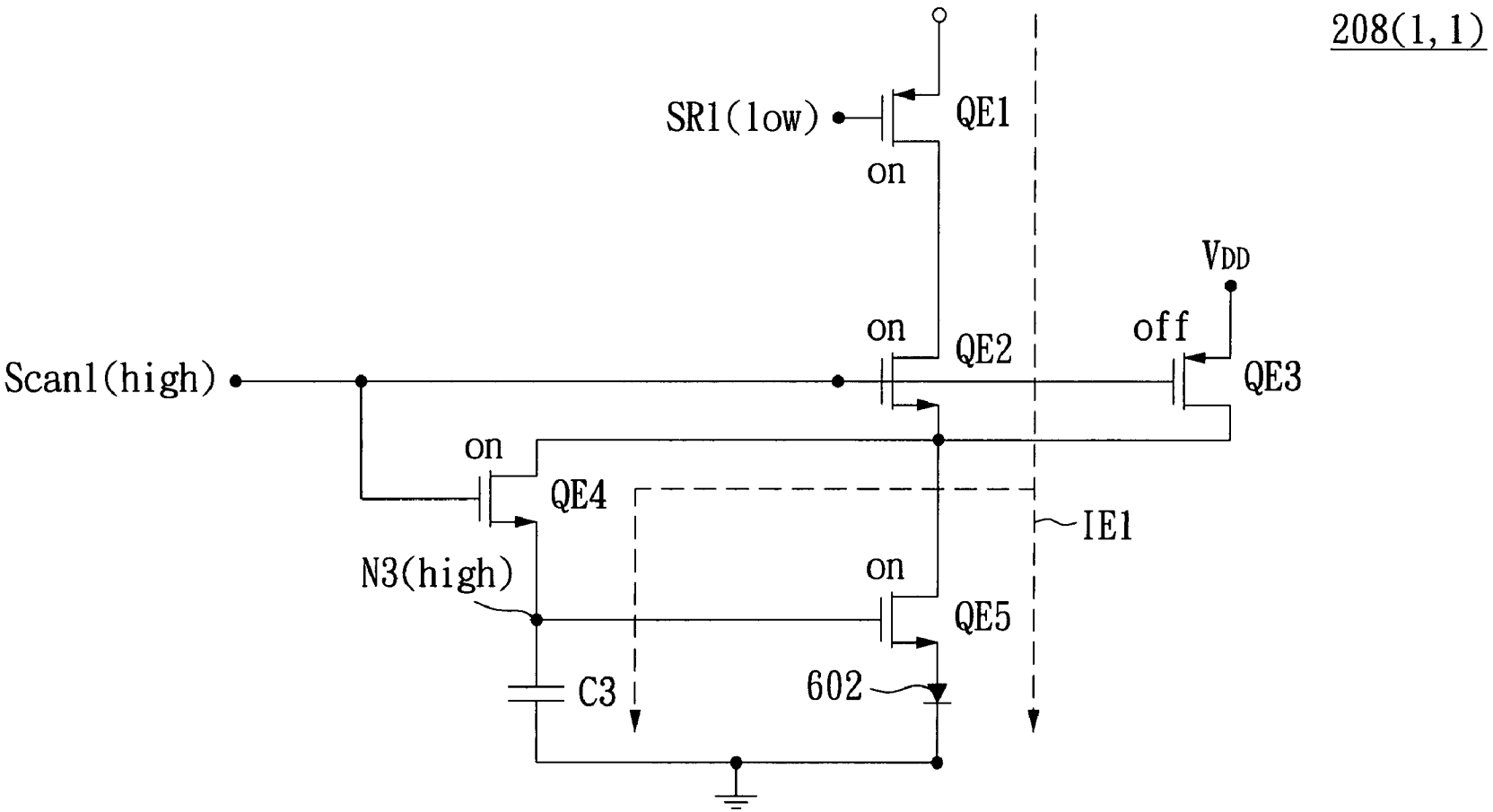
FIGS. 6A and 6B are an example of the circuit structure of a pixel 208(1, 1)
Figure 6B:
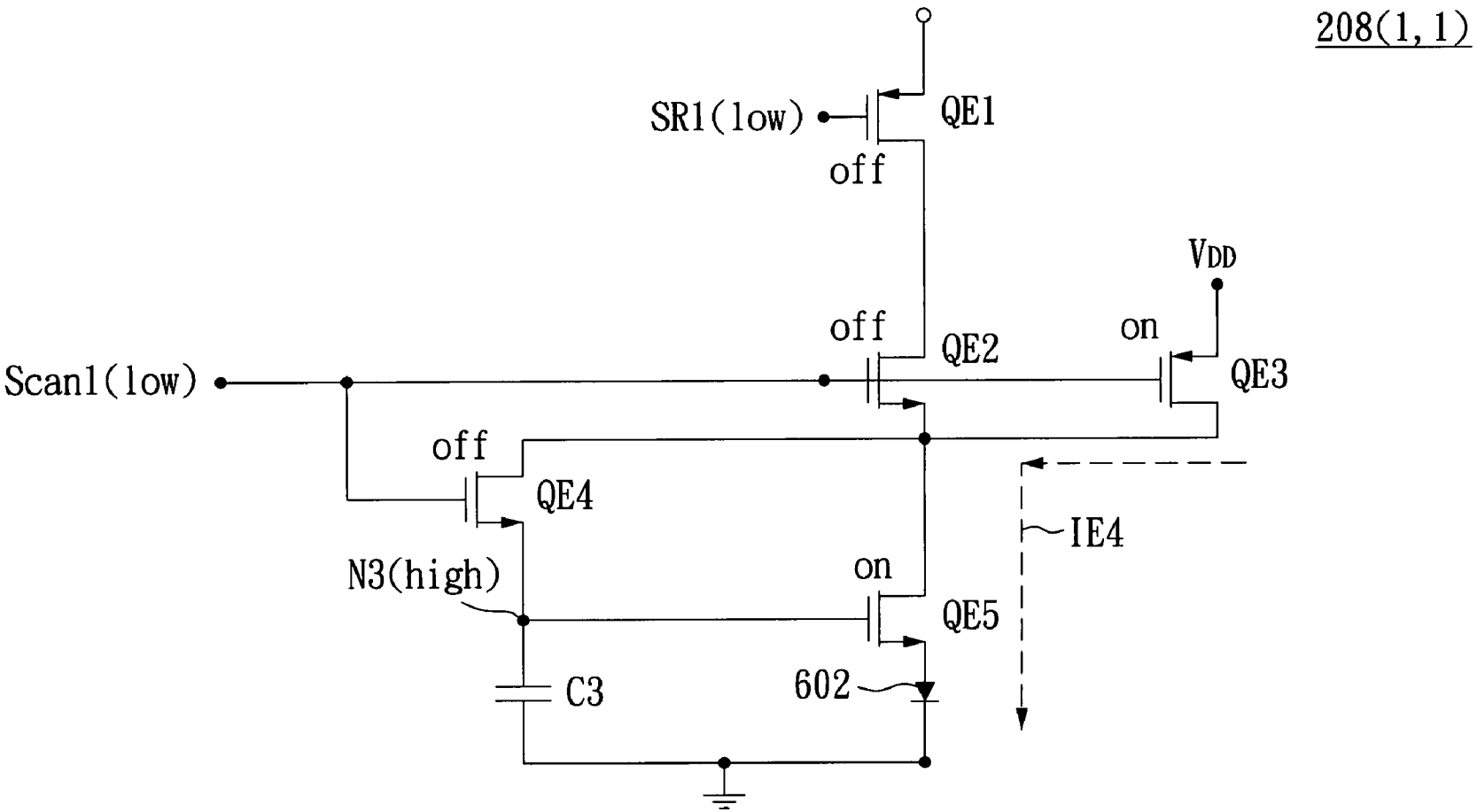

Referring to FIGS. 6A and 6B, an example of the circuit structure of a pixel 208(1, 1) is shown. The pixel 208(1, 1) includes N-type transistors QE2, QE4 and QE5, P-type transistor QE3 and an OLED 602. The negative end of the OLED 602 is grounded while the positive end of the OLED 602 is coupled to the source of the transistor QE5. The two ends of the capacitor C3 are respectively coupled to the gate of the transistor QE5 and the cathode of the OLED 602. The source of the transistor QE2 and the drain of the transistor QE3 are both coupled to the drain of the transistor QE5. The drain of the transistor QE4 is coupled to the drain of the transistor QE5, while the source of the transistor QE4 is coupled to the gate of the transistor QE5. The source of the transistor QE1 is coupled to output ends Output1 and Output2, while the drain of the transistor QE1 is coupled to the drain of the transistor QE2, wherein the transistor QE1 is the switch SWC(1).

Referring to FIG. 6A, the horizontal control signal SR1 is inputted into the gate of the transistor QE1, while the scan signal Scan1 is inputted into the gates of the transistors QE2, QE3 and QE4. When the horizontal control signal SR1 is disabled and the scan signal Scan 1 is enabled, the transistor QE1 is turned on, the main regenerating current IN'(1) and the secondary regenerating current IM'(1) are inputted into the pixel 208(1, 1) at the same time, and flow through the transistors QE2, QE4 and QE5 and charge the capacitor C3. When the cross-voltage of the capacitor C3 is at a fourth specific level, the magnitude of the current IE1 flowing through the transistor QE5 is equal to the sum of the main regenerating current IN'(1) and the secondary regenerating current IM'(1).

Referring to FIG. 6B, when the scan signal Scan1 is disabled, the transistors QE2 and QE4 are turned off and the transistors QE3 and QE5 are turned on. Meanwhile, as the capacitor C3 is maintained at the fourth specific level, IE4, the current flowing through the transistor QE5, is substantially equal to IE3, the sum of the main regenerating current IN'(1) and the secondary regenerating current IM'(1). Meanwhile, the pixel 208(1, 1) is enter a pixel current regenerating mode until the scan signal Scan1 is enabled at the next frame.

Figure 7:
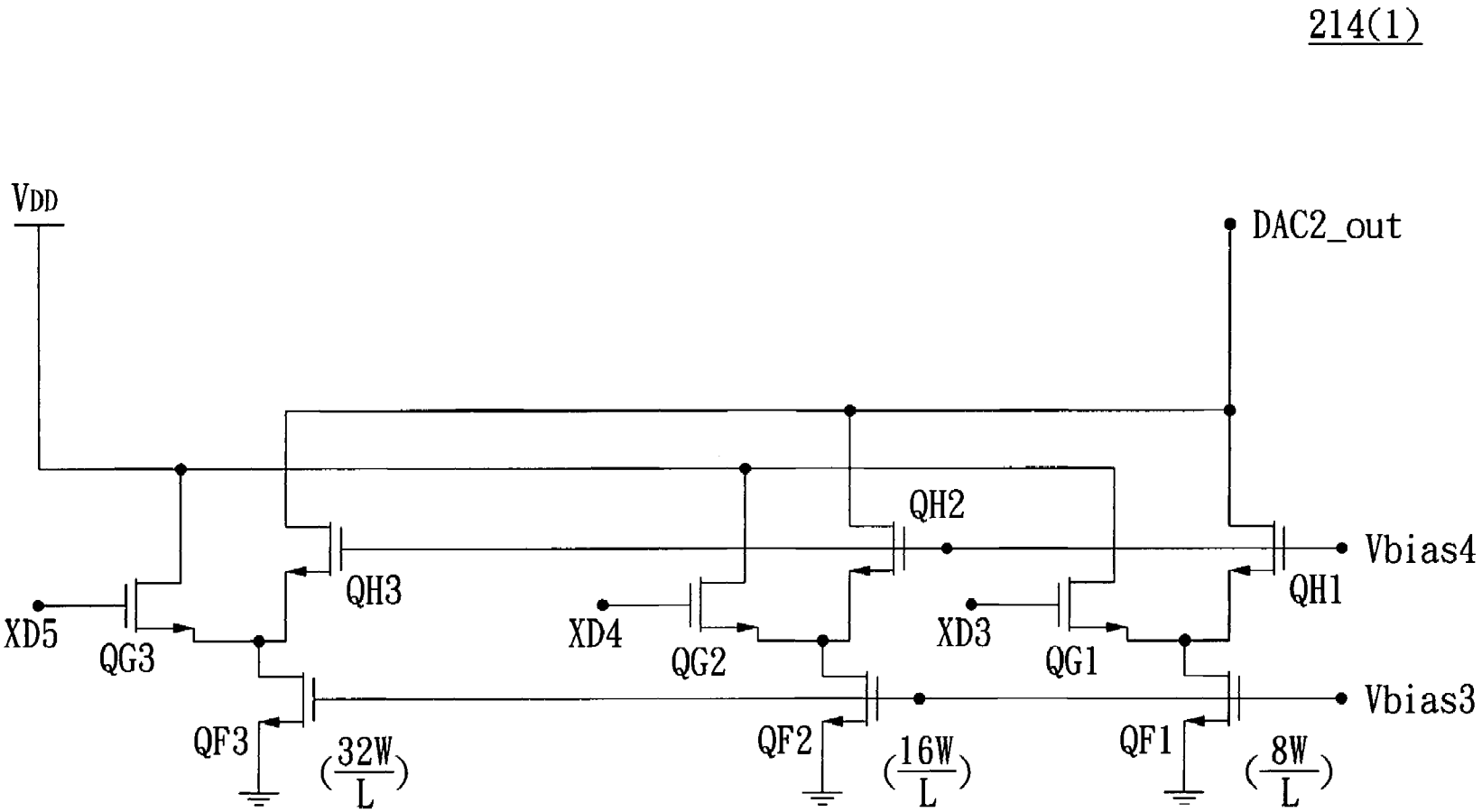
FIG. 7 is an example of the circuit structure of an secondary digital-to-analog current converter 214(1)

Referring to FIG. 7, an example of the circuit structure of a secondary digital-to-analog current converter 214(1) is shown. The secondary digital-to-analog current converter 214 includes 9 N-type transistors QF1~QF3, QG1~QG3 and QC1~QH3. The gates of the transistors QG1~QG3 respectively receives XD3, XD4 and XD4, the anti-phase signals of signals D3, D4 and D5. The connection and operation of the secondary digital-to-analog current converter 214 is similar to that of the main digital-to-analog current converter 210(1) except that the width-to-length ratios for respective channels of the transistors QF1~QF3 are 8W/L, 16W/L and 32W/Land generate currents 8I1, 16I1 and 32I1 respectively.

Figure 8:
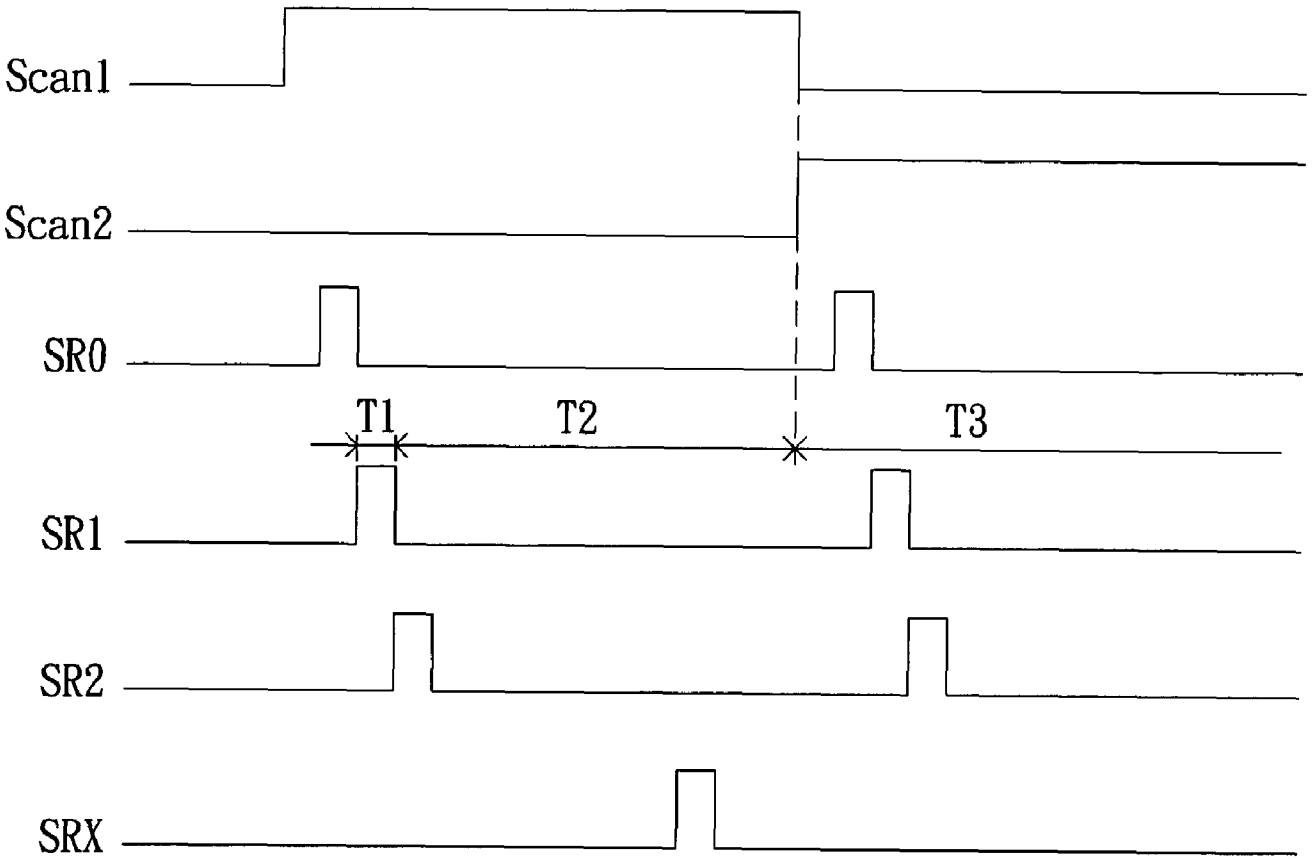
FIG. 8 is an example of the waveform of horizontal control signals SR0, SR1 and SRX as well as scan signals Scan1 and Scan2.

Referring to FIG. 8, an example of the waveform of horizontal control signals SR0, SR1 and SRX as well as scan signals Scan1 and Scan2 is shown. During period T1, when both the scan signal Scan1 and the horizontal control signal SR1 are enabled, both the main voltage storing current copier/current mirror 212(1) and the secondary voltage storing current copier/current mirror 216(1) are in current storing mode. During period T2, when the scan signal Scan1 is enabled but the horizontal control signal SR1 is disabled, the main voltage storing current copier/current mirror 212(1) and the secondary voltage storing current copier/current mirror 216(1) are in the current regenerating mode. During period T3, when the scan signal Scan1 is disabled, the pixel 208(1, 1) enter the pixel current regenerating mode.

In the first embodiment, when the high voltage level of the digital pixel data Dt is high enough, both the main level shifters 220 and the secondary level shifter 222 can be omitted and the abovementioned switches can be implemented by N-type transistor, P-type transistor or transmission gate. The application of the invention is not limited to the main digital-to-analog current converter and the secondary digital-to-analog current converter disclosed above. The invention can be applied to any kinds of digital-to-analog converters which can convert digital signals into analog current signals. The application of the invention is not limited to the main voltage storing current copier/current mirror and the secondary voltage storing current copier/current mirror either. The invention can be applied to any current copiers or current mirrors which store the voltage difference between the gate and the source of a TFT.

The first embodiment is disclosed by example of outputting current to a pixel by the main voltage storing current copier/current mirror and the secondary voltage storing current copier/current mirror. However, the first embodiment can also be applied to the design of sinking current from a pixel by the main voltage storing current copier/current mirror and the secondary voltage storing current copier/current mirror.

Furthermore, the N bits data of the pixel data in the invention can be an N-bit MSB data, while the M bits data of the pixel data can be an M-bit LSB data. The invention is not limited to the use of one secondary digital-to-analog current converter. If two or more secondary digital-to-analog current converters are used, the K bits data of the pixel data need to be divided into three groups. Moreover, for pixels in the same column, the invention can use two main voltage storing current copier/current mirror and two secondary voltage storing current copier/current mirror to alternatively provide the pixel with main regenerating current and secondary regenerating current when the horizontal control signal is enabled or disabled.

Embodiment Two

Figure 9:
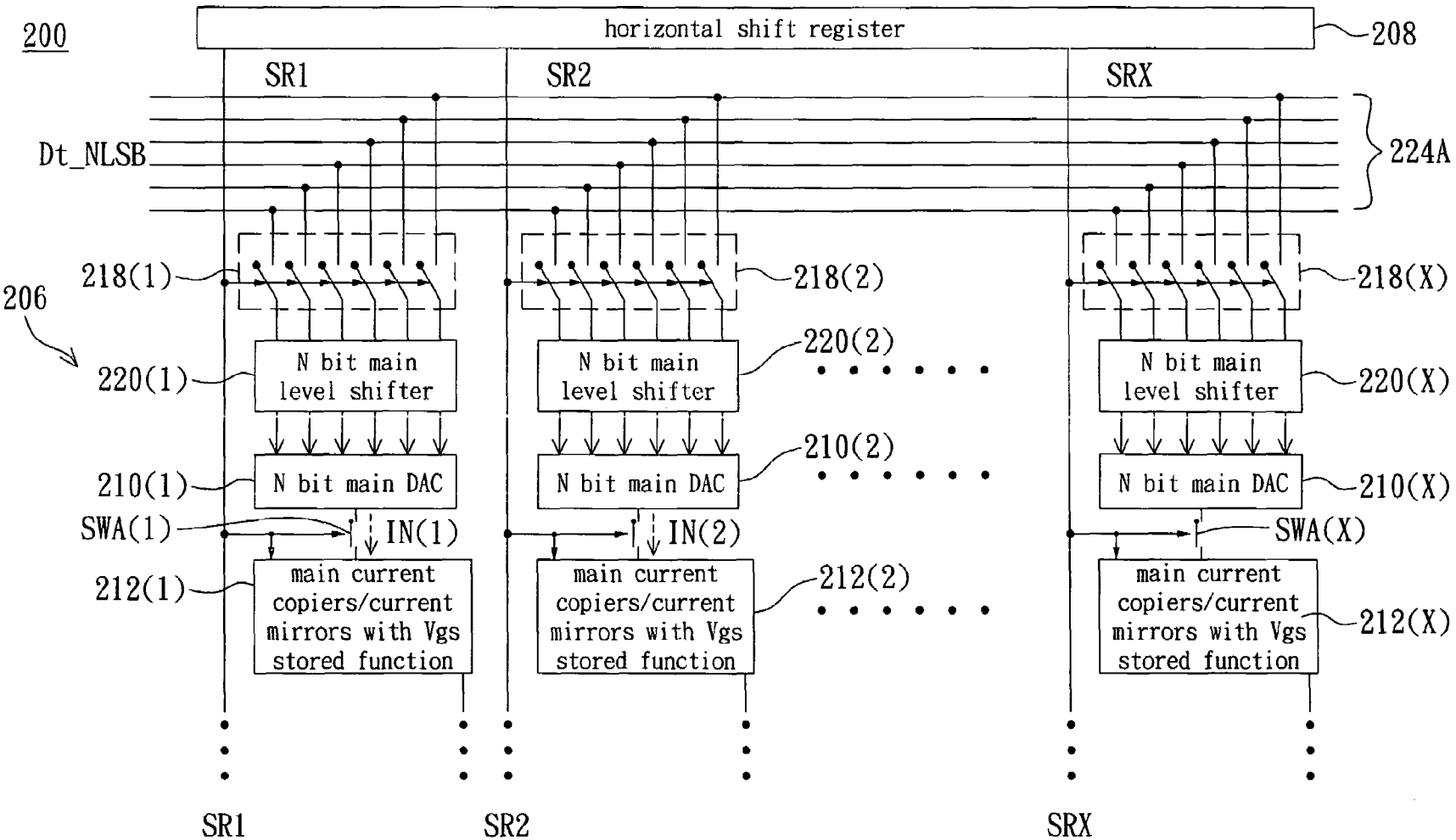
FIG. 9 is a driving circuit for an OLED display according to the second embodiment of the invention.
Figure 9:
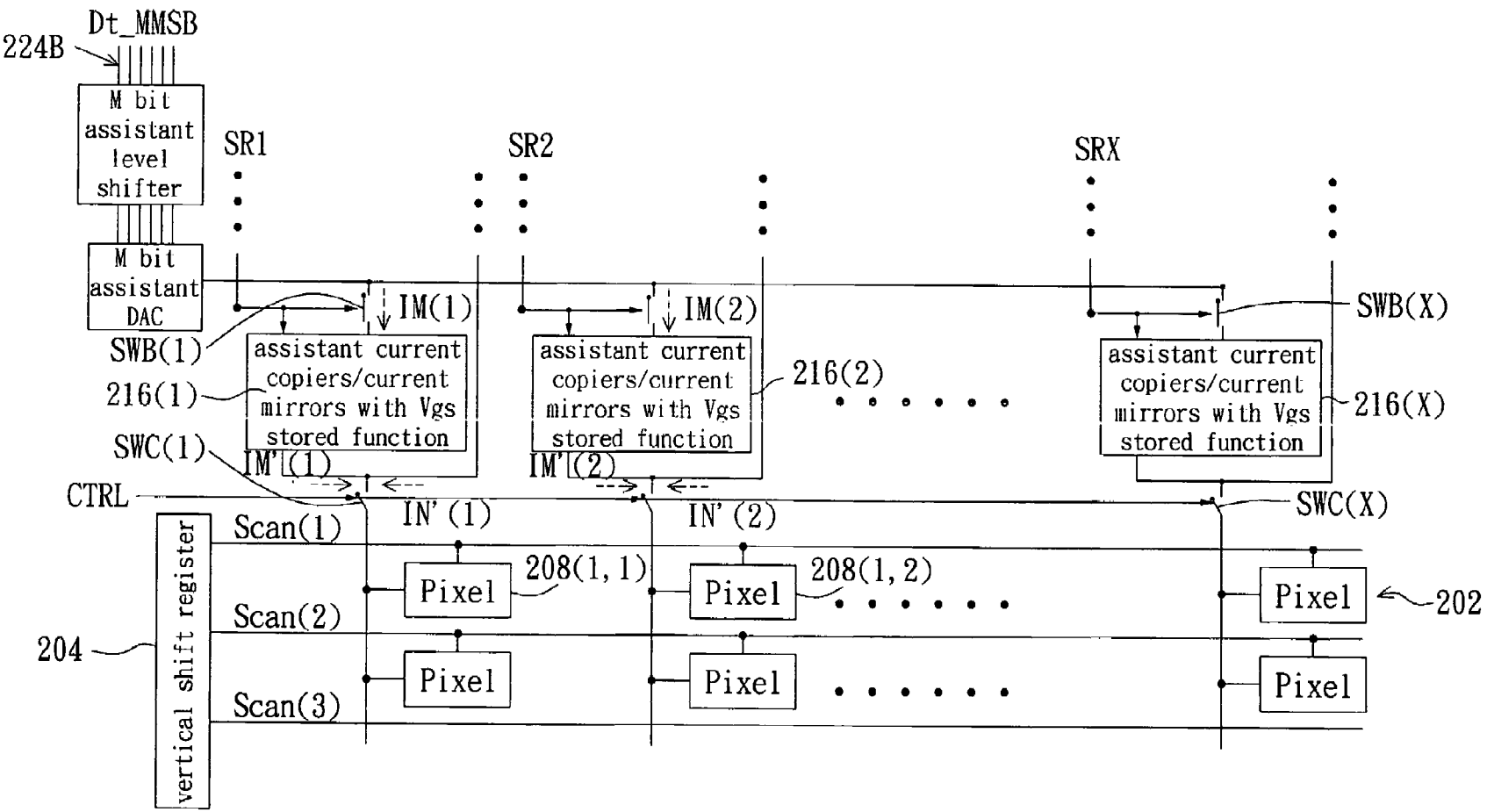
Figure 10:
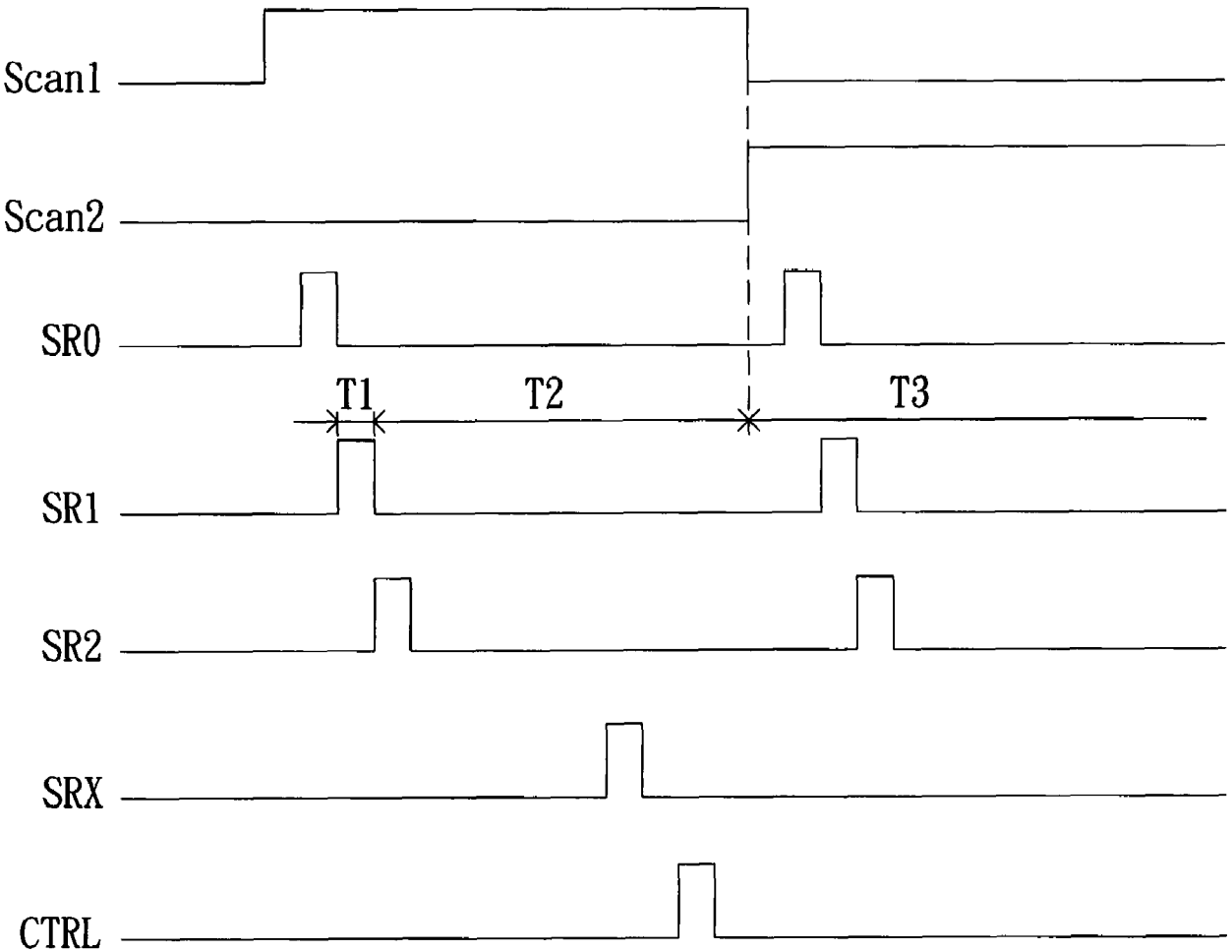
FIG. 10 is an example of the waveform of horizontal control signals SR0, SR1 and SRX as well as scan signals Scan1 and Scan2 according to the second embodiment of the invention.

In the first embodiment, the switches SWC(1)~SWC(X) are respectively controlled by horizontal control signals SR1~SRX. In the second embodiment, the switches SWC(1)~SWC(X) are controlled by switch control signals CTRL as shown in FIG. 9. Referring to FIG. 10, an example of the waveform of horizontal control signals SR0, SR1 and SRX as well as scan signals Scan1 and Scan2 according to the second embodiment of the invention is shown. After all of the main voltage storing current copier/current mirror and the secondary voltage storing current copier/current mirror have generated main regenerating current and secondary regenerating current, the switch control signal CTRL will become enabled so that the switches SWC(1)~SWC(X) can be turned on. Take the first row pixel for example. The main regenerating current IN'(1) and the secondary regenerating current IM'(1) are inputted into the pixel 208(1, 1), while the main regenerating current IN'(2) and the secondary regenerating current IM'(2) are inputted into the pixel 208(1, 2). Similarly, the main regenerating currents IN'(3)~IN'(X) and the secondary regenerating currents IM'(3)~IM'(X) are respectively inputted into the pixels 208(1, 3)~208(1, X) to illuminate corresponding pixels.

The data driver for organic light emitting diode display disclosed in the above embodiments can effectively reduce the error in the output current of a digital-to-analog circuit so as to provide more uniform brightness across the pixels of the TFT-OLED panel.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A data driver for a display having a first pixel and a second pixel, the data driver receiving a first pixel data and a second pixel data, both of the first pixel data and the second pixel data having K bits where K is a positive integer, the data driver comprising:

a first main digital-to-analog current converter for converting N bits of the first pixel data into a first main output current where N is a positive integer;

a second main digital-to-analog current converter for converting N bits of the second pixel data into a second main output current;

a first main voltage storing current copier/current mirror for outputting a first main regenerating current according to the first main output current;

a second main voltage storing current copier/current mirror for outputting a second main regenerating current according to the second main output current;

a secondary digital-to-analog current converter for receiving M bits from the first pixel data and M bits from the second pixel data to generate a first secondary output current and a second secondary output current correspondingly where M is a positive integer;

a first secondary voltage storing current copier/current mirror for outputting a first secondary regenerating current according to the first secondary output current; and a second secondary voltage storing current copier/current mirror for outputting a second secondary regenerating current according to the second secondary output current;

whereby brightness of the first pixel is determined by the sum of the first main regenerating current and the first secondary regenerating current, and brightness of the second pixel is determined by the sum of the second main regenerating current and the second secondary regenerating current.

2. The data driver according to claim 1, further comprising a horizontal shift register for outputting a first horizontal control signal and a second horizontal control signal, wherein the first main digital-to-analog current converter receives N bits of the first pixel data according to the first horizontal control signal and the second main digital-to-analog current converter receives N bits of the second pixel data according to the second horizontal control signal.

3. The data driver according to claim 1, further comprising:

a first switch for switching the first main regenerating current and the first secondary main regenerating current to the first pixel; and a second switch for switching the second main regenerating current and the second secondary main regenerating current to the second pixel.

4. The data driver according to claim 1, wherein when the sum of M and N equals K, the N bits data of the first pixel data is N-bit least significant bit (LSB) data and the M bits data of the first pixel data is M-bit most significant bit (MSB) data, while the N bits data of the second pixel data is N-bit LSB data and the M bits data of the second pixel data is M-bit MSB data.

5. The data driver according to claim 1, wherein when the sum of M and N equals K, the N bits data of the first pixel data is N-bit MSB data and the M bits data of the first pixel data is M-bit LSB data, while the N bits data of the second pixel data is N-bit MSB data and the M bits data of the second pixel data is M-bit LSB data.

6. The data driver according to claim 1, further comprising:

a first main level shifter for amplifying the N bits data of the first pixel data into an amplified N bits data of the first pixel data and outputting the amplified N bits data of the first pixel data to the first main digital-to-analog current converter;

a second main level shifter for amplifying the N bits data of the second pixel data into an amplified N bits data of the second pixel data and outputting the amplified N bits data of the second pixel data to the second main digital-to-analog current converter; and a secondary level shifter for amplifying M bits data of the first pixel data into an amplified M bits data of the first pixel data and output the amplified M bits data of the first pixel data to the secondary digital-to-analog current converter.

7. A display, comprising:

a pixel array comprising a first pixel and a second pixel;

a vertical shift register for outputting a scan signal to the first pixel and the second pixel; and a data driver for receiving a first pixel data and a second pixel data, both of which have K bits where K is a positive integer, the data driver comprising:

a horizontal shift register for outputting a first horizontal control signal and a second horizontal control signal;

a first main digital-to-analog current converter controlled by the first horizontal control signal for converting N bits of the first pixel data into a first main output current where N is a positive integer;

a second main digital-to-analog current converters controlled by the second horizontal control signals for converting N bits of the second pixel data into a second main output current;

a first main voltage storing current copier/current mirror for outputting a first main regenerating current according to the first main output current;

a second main voltage storing current copier/current mirror for outputting a second main regenerating current according to the second main output current;

an secondary digital-to-analog current converter for receiving M bits of the first pixel data and M bits of the second pixel data to generate a first and a second secondary output currents correspondingly where M is a positive integer;

a first secondary current copier/current mirror circuit for outputting a first secondary regenerating current according to the first secondary output current; and a second secondary voltage storing current copier/current mirror for outputting a second secondary regenerating current according to the second secondary output current;

whereby brightness of the first pixel is determined by the sum of the first main regenerating current and the first secondary regenerating current, and brightness of the second pixel is determined by the sum of the second main regenerating current and the second secondary regenerating current.

8. The display according to claim 7, wherein the display is an organic light emitting diode (OLED) display.

9. A driving method applied in a display having a first pixel and a second pixel, the driving method comprising:

receiving a first pixel data and a second pixel data, both of the first pixel data and the second pixel data having K bits where K is a positive integer;

converting N bits of the first pixel data into a first main output current where N is a positive integer;

converting N bits of the second pixel data into a second main output current;

generating a first main regenerating current according to the first main output current;

generating a second main regenerating current according to the second main output current;

generating a first secondary output current and a second secondary output current according to M bits of the first pixel data and M bits of the second pixel data where M is a positive integer;

generating a first secondary regenerating current according to the first secondary output current; and generating a second secondary regenerating current according to the second secondary output current;

whereby brightness of the first pixel is in response to the sum of the first main regenerating current and the first secondary regenerating current, and brightness of the second pixel is in response to the sum of the second main regenerating current and the second secondary regenerating current.

10. The driving method according to claim 9, further comprising:

generating a first horizontal control signal and a second horizontal control signal after the step of receiving a first pixel data and a second pixel data, wherein the N bits of the first pixel data are received according to the first horizontal control signal and the N bits of the second pixel data are received according to the second control signals.

11. The driving method according to claim 9, wherein when the sum of M and N equals K, the N bits data of the first pixel data is N-bit least significant bit (LSB) data and the M bits data of the first pixel data is M-bit most significant bit (MSB) data, while the N bits data of the second pixel data is N-bit LSB data and the M bits data of the second pixel data is M-bit MSB data.

12. The driving method according to claim 9, wherein when the sum of M and N equals K, the N bits data of the first pixel data is N-bit MSB data and the M bits data of the first pixel data is M-bit LSB data, while the N bits data of the second pixel data is N-bit MSB data and the M bits data of the second pixel data is M-bit LSB data.

13. A data driver for a display having a first pixel and a second pixel, the data driver receiving a first pixel data and a second pixel data, both of the first pixel data and the second pixel data having K bits where K is a positive integer, the data driver comprising:

a first main digital-to-analog current converter for converting N bits of the first pixel data into a first main output current where N is a positive integer;

a second main digital-to-analog current converter for converting N bits of the second pixel data into a second main output current;

a first main voltage storing current copier/current mirror, being selectively coupled to the first main digital-to-analog current converter and being for outputting a first main regenerating current in response to the first main output current;

a second main voltage storing current copier/current mirror, being selectively coupled to the second main digital-to-analog current converter and being for outputting a second main regenerating current in response to the second main output current;

a secondary digital-to-analog current converter for receiving M bits from the first pixel data and M bits from the second pixel data to generate a first secondary output current and a second secondary output current correspondingly where M is a positive integer;

a first secondary voltage storing current copier/current mirror being selectively coupled to the secondary digital-to-analog current converter and being for outputting a first secondary regenerating current in response to the first secondary output current; and a second secondary voltage storing current copier/current mirror being selectively coupled to the secondary digital-to-analog current converter and being for outputting a second secondary regenerating current in response to the second secondary output current;

whereby brightness of the first pixel is in response to the sum of the first main regenerating current and the first secondary regenerating current, and brightness of the second pixel is in response to the sum of the second main regenerating current and the second secondary regenerating current.

* * * * *